US011508343B2

(12) United States Patent
Wernick et al.

(10) Patent No.: US 11,508,343 B2
(45) Date of Patent: Nov. 22, 2022

(54) ISOLATION MOUNT FOR A PERCUSSION INSTRUMENT

(71) Applicant: Wernick Ltd., Leicester (GB)

(72) Inventors: William Wernick, Leicester (GB); Julie-Ellen John, Leicester (GB)

(73) Assignee: Wernick Ltd., Leicester (GB)

( * ) Notice: Subject to any disclaimer, the term of this patent is extended or adjusted under 35 U.S.C. 154(b) by 0 days.

(21) Appl. No.: 17/652,987

(22) Filed: Mar. 1, 2022

(65) Prior Publication Data

US 2022/0180846 A1 Jun. 9, 2022

(51) Int. Cl.
*G10D 13/14* (2020.01)
*G10D 13/10* (2020.01)

(52) U.S. Cl.
CPC ..... *G10D 13/14* (2020.02); *G10D 13/26* (2020.02)

(58) Field of Classification Search
CPC ..... G10D 13/14; G10D 13/08
See application file for complete search history.

(56) References Cited

U.S. PATENT DOCUMENTS 2,140,429 A * 12/1938 Laffey ..... G10D 13/08 984/155
2,565,225 A * 8/1951 Gladstone ..... G10D 13/02 84/411 R
2,971,424 A * 2/1961 Kent ..... G10D 13/08 84/404
3,443,469 A * 5/1969 Hiraoka ..... G10D 13/08 984/155
4,137,815 A * 2/1979 Kloc ..... G10D 13/08 984/151
4,406,207 A * 9/1983 Criscione ..... G10D 13/03 84/421
4,679,479 A * 7/1987 Koyamato ..... G10D 13/02 84/DIG. 24
4,947,725 A * 8/1990 Nomura ..... G10H 3/146 84/723
5,042,356 A * 8/1991 Karch ..... G10D 13/02 84/411 R
5,105,710 A * 4/1992 Rothmel ..... G10D 13/02 84/DIG. 12
5,293,000 A * 3/1994 Adinolfi ..... G10H 3/146 84/DIG. 12

(Continued)

*Primary Examiner* — Robert W Horn
(74) *Attorney, Agent, or Firm* — Tatonetti IP

(57) ABSTRACT

A percussion instrument is adapted with a foam arrangement directly or indirectly in communication with its percussion surface. The foam arrangement reduces acoustic impact sounds when the instrument is struck, helps isolate vibrations from nearby percussion surfaces, and reduces or removes sound generation when air is released from the damper. To achieve these results, directly or indirectly secured to the percussion surface is an open-cell foam layer that is configured with a closed-cell foam layer positioned in a lateral side-by-side arrangement to create a spring and damper system. The open-cell foam may have one or more holes that extend entirely through its body, and inside those, one or more holes are closed-cell foam to provide additional spring-like functionality. The side-by-side dual-layer arrangement enables the closed- and open-cell foam layers to operate in tandem—the closed-cell layer operates as a spring, and the open-cell layer operates as a damper.

11 Claims, 13 Drawing Sheets

(56) References Cited

U.S. PATENT DOCUMENTS 6,362,407 B1 * 3/2002 Dennis ..... G10D 13/03 84/411 R
7,259,317 B2 * 8/2007 Hsien ..... G10H 3/146 84/723
7,692,083 B2 * 4/2010 Aspland ..... G10D 13/18 84/411 R
7,737,351 B2 * 6/2010 Suzuki ..... G10D 13/26 84/411 R
8,148,617 B2 * 4/2012 Hashimoto ..... G10D 13/02 84/411 P
8,253,001 B1 * 8/2012 Liu ..... G10D 13/26 84/411 R
8,358,050 B2 * 1/2013 Cappello ..... G10H 3/143 310/338
8,884,151 B1 * 11/2014 Lee ..... G10D 13/26 84/743
9,129,585 B2 * 9/2015 Kanayama ..... G10H 1/32
9,583,081 B2 * 2/2017 Broadbelt ..... G10D 13/03
9,672,802 B2 * 6/2017 Muzzio ..... G10D 13/02
9,761,212 B2 * 9/2017 Suitor ..... G10H 3/183
10,127,896 B2 * 11/2018 Irisa ..... G10D 13/08
10,152,956 B1 * 12/2018 McIntyre ..... G10D 13/02
2006/0065099 A1 * 3/2006 Anderson ..... G10D 13/02 84/411 M
2015/0082967 A1 * 3/2015 Yoshino ..... G10D 13/02 84/411 M
2015/0243266 A1 * 8/2015 May ..... G10D 13/14 84/421
2016/0140945 A1 * 5/2016 De Virgiliis ..... G10D 13/26 84/725
2019/0126597 A1 * 5/2019 Ziegler ..... F16C 33/201
2020/0055288 A1 * 2/2020 Hosoda ..... B32B 5/18
2020/0234686 A1 * 7/2020 Hosoda ..... B32B 25/10
2020/0332518 A1 * 10/2020 Komoto ..... H04R 17/005
2021/0256946 A1 * 8/2021 Harada ..... G10H 3/146
2022/0180846 A1 * 6/2022 Wernick ..... G10D 13/14

* cited by examiner

Front side view
(205)

ISOLATION MOUNT FOR A PERCUSSION INSTRUMENT

BACKGROUND

Certain percussion instruments, such as xylosynths and drum triggers, among others, utilize an electronic sensor directly or indirectly attached to a percussion surface to detect vibrations generated from an impact strike, such as with a mallet, drumstick, hand, etc. Occasionally, vibrations from other percussion surfaces mounted on the same frame can cause vibrations and interfere with the signal of the originally hit surface. Other external vibrations can also affect the signal. Such interference is generally referred to as crosstalk or noise, and the relative magnitude of the interference determines the quality of the interfered signal to be analyzed. While a noise threshold can be set in software as well as other sophisticated filters, if the signal-to-noise ratio can be improved, then a better-quality instrument can be achieved, particularly for light strikes against percussion surfaces.

In some implementations, percussion surfaces are mounted onto an open-cell soft foam-like material on top or underneath a stiffer rubberlike material. Such a configuration can absorb the vibrations transmitted to other percussion surfaces and isolate vibrations received from other percussion surfaces. Some mounting systems may omit one or both of the open-cell foam and stiffer material. Interference can still be present even with such configurations, however.

SUMMARY

A percussion instrument is adapted with a foam arrangement directly or indirectly in communication with its percussion surface. The foam arrangement reduces acoustic impact sounds when the instrument is struck, helps isolate vibrations from nearby percussion surfaces, and reduces or removes sound generation when air is released from the damper. To achieve these results, directly or indirectly secured to the percussion surface is an open-cell foam layer that is configured with a closed-cell foam layer positioned in a lateral side-by-side arrangement to create a spring and damper system.

For example, the open-cell foam layer may have one or more holes that extend fully through its body, and inside those one or more holes are closed-cell foam layers to provide additional spring-like functionality to the arrangement. The side-by-side dual-layer arrangement enables the closed- and open-cell foam layers to operate in tandem—the closed-cell layer operates as a spring, and the open-cell layer operates as a damper. While the closed-cell foam layer is described herein as the spring structure, other spring structures that interoperate with the open-cell foam layer are also possible, such as metal or plastic springs including a constant coil or flat springs, among other spring-like structures.

In terms of a xylosynth, attached to the bottom of a key's percussion surface is a closed-cell foam layer, and attached to a bottom surface of the closed-cell foam layer is an open-cell foam layer. The closed-cell and open-cell foam layers may each utilize double-sided adhesive to attach to the various adjacent components. In this implementation, the open cell foam layer is further configured with a distinct closed-cell foam layer positioned in a laterally side-by-side arrangement to create the spring and damper system discussed above. Although two distinct closed-cell foam layers are discussed herein, the closed-cell foam layer that is side-by-side with the open-cell foam layer is the component that provides the spring-like functionality.

In typical implementations, each foam layer may be comprised of an EPDM (ethylene propylene diene monomer rubber) material which is configured with properties that effectuate the benefits described herein. For example, the closed-cell foam layer substantially prevents air from entering or escaping its cellular structure while still being able to flatten its cells—to an extent—and then springing back to its normal pre-configured position.

While the closed-cell foam layer prevents airflow therein and functions as a spring, the open-cell foam layer permits internal airflow such that air can enter and escape its cellular structure. Despite its airflow properties, the open-cell foam layer can still restrict airflow as it passes through the cells, functioning as a damper to the percussion instrument. While a specific implementation is shown and described herein, this dual-layer arrangement's characteristics and specific implementation can be modified to accommodate various scenarios/and percussion instruments. For example, the sizes of the foam layers, proportions or ratios between the closed- and open-cell foam layer arrangement, and the foam layers' densities can all be modified.

The open-cell foam layer's bottom surface attaches to a bottom frame that hosts the screws or other attachment mechanisms that attach the percussion instrument to some support structure. The foam arrangement discussed herein may be utilized for any number of percussion instruments or other surfaces that receive some sort of force and then recoil back into position. The discussion herein is directed to a Xylosynth™ instrument, but the present implementation may also apply to drum triggers and other percussion instruments.

This Summary is provided to introduce a selection of concepts in a simplified form that is further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. It will be appreciated that the above-described subject matter may be implemented as a computer-controlled apparatus, a computer process, a computing system, or as an article of manufacture such as one or more computer-readable storage media. These and various other features will be apparent from reading the following Detailed Description and reviewing the associated drawings.

BRIEF DESCRIPTION OF THE DRAWINGS

Like reference numerals indicate like elements in the drawings. Elements are not drawn to scale unless otherwise indicated.

DETAILED DESCRIPTION

Figure 1:
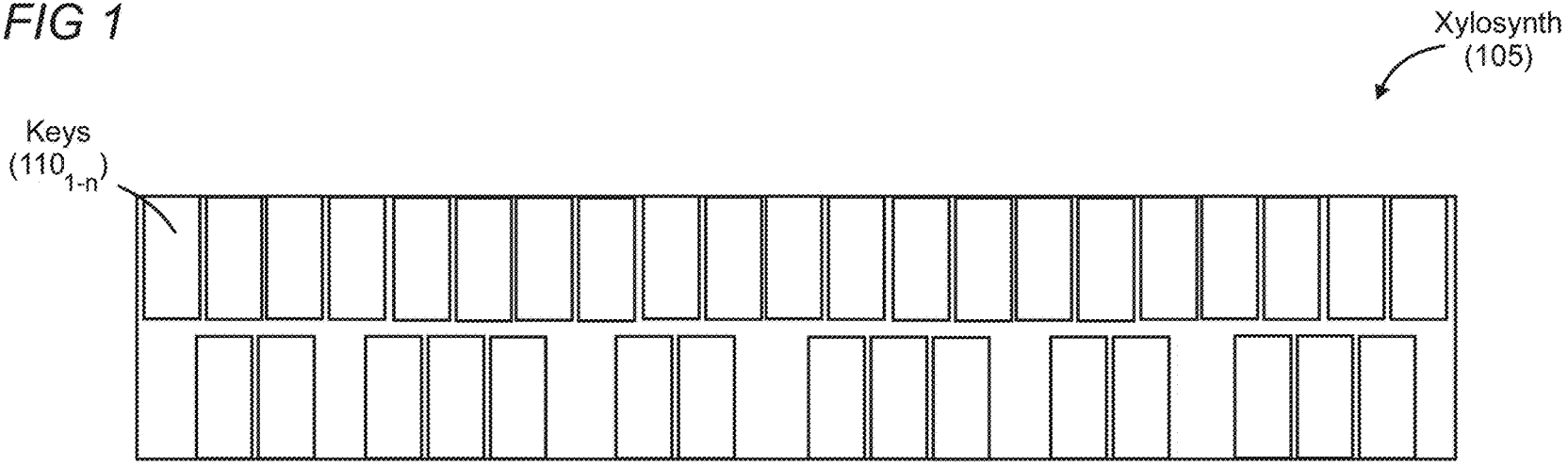
FIG. 1 shows an illustrative representation of a Xylosynth™ musical instrument.

FIG. 1 shows an illustrative representation of a xylosynth instrument 105 with keys 110, which function as percussion surfaces. A user may use a mallet to strike the individual keys, resulting in audio output from a speaker hooked up to the xylosynth. Although a xylosynth instrument is illustrated and discussed herein, the implementations may work with other percussion instruments and surfaces as well, including, for example, drum triggers. Thus, the xylosynth is used for exemplary purposes only, and the present disclosure is not meant to be limited thereto.

Figure 2:
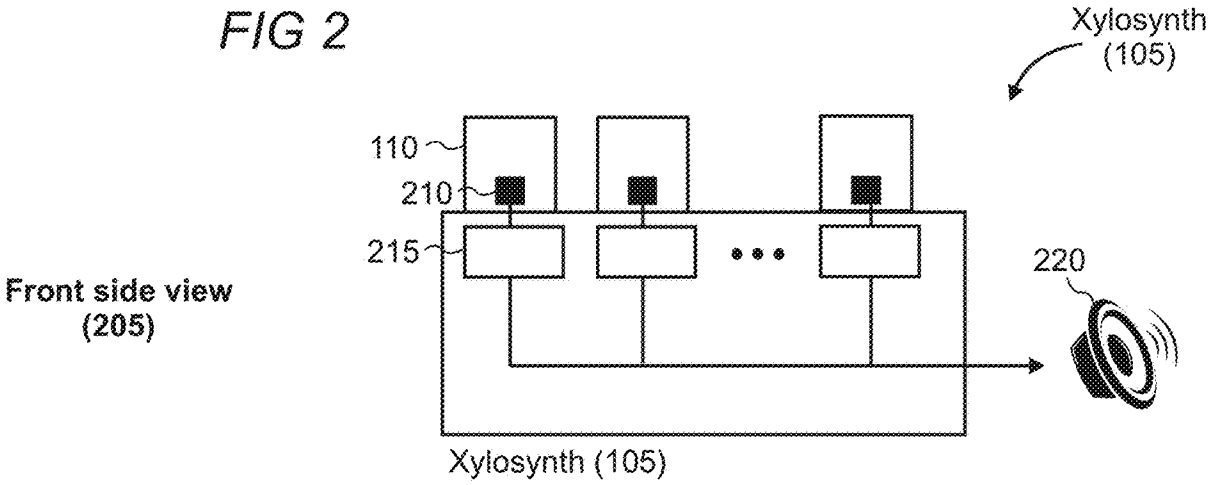
FIG. 2 shows an illustrative schematic representation of the xylosynth instrument from its side.

FIG. 2 shows an illustrative front side view 205 diagram of a portion of the xylosynth 105 in which some of the internal operational components of the xylosynth are shown. The keys 110 may be connected to a vibration sensor 210 that detects and measures vibrations generated after a user strikes a respective key. In typical implementations, the sensor may be directly or indirectly attached underneath the percussion surface, but in other scenarios, such as the drum trigger, the sensor may be positioned on the side of the instrument.

Each respective sensor may be operatively connected to a respective processor 215, such as a signal processor that processes the received vibration and then outputs an audio signal for output by a speaker 220. While multiple respective signal processors are shown in FIG. 2, in other implementations, a single processor may be utilized to receive the vibration signals transmitted from the respective keys, and other configurations are also possible. The one or more processors may be operatively connected to a memory device that includes instructions and data in generating the output audio signal.

Figure 3:
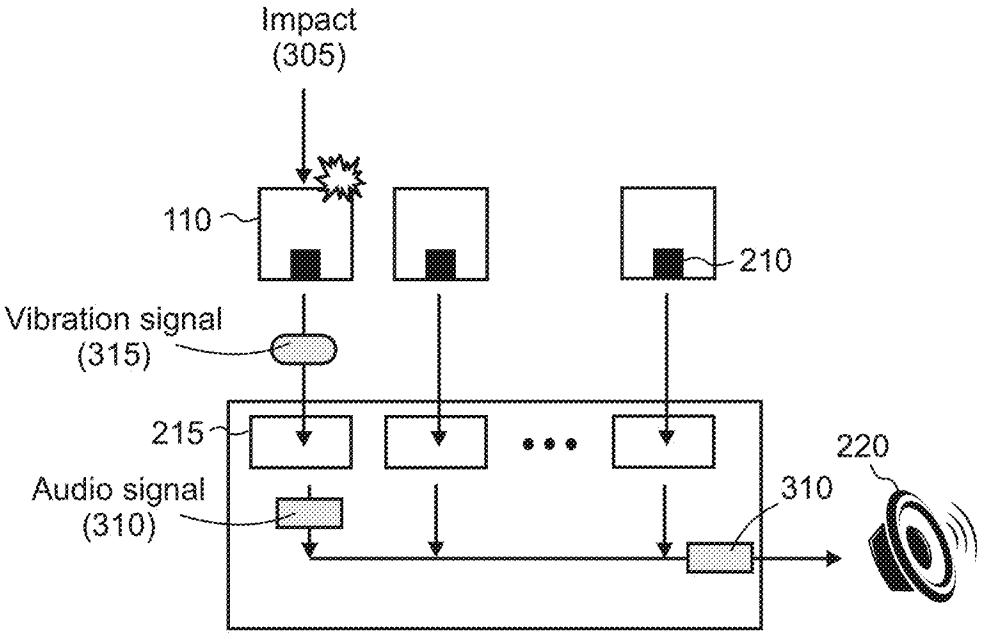
FIG. 3 shows an illustrative operational representation of the xylosynth.

FIG. 3 shows an illustrative representation in which the key 110 receives an impact 305, such as from a mallet. The vibration sensor 210 detects and measures the vibration from the impact and transmits the measured signal 315 to the signal processor 215. The signal processor translates the received vibration signal into an audio signal 310, which is then transmitted to the speaker 220 for auditory output. Further discussion about the xylosynth's and similar percussion instrument configurations and method of operation can be viewed at U.S. Pat. No. 9,837,062, filed Jan. 5, 2017, issued Dec. 5, 2017, entitled "Percussion Instrument and Signal Processor," the entire contents of which is hereby incorporated herein by reference.

Although FIGS. 2 and 3 show the transmission of audio information to a speaker, the xylosynth or other percussion instrument may alternatively be used as a MIDI (musical instrument digital interface) controller, in which digital information is transmitted, and lighting and other effects can be controlled, as well as audio.

Figure 4:
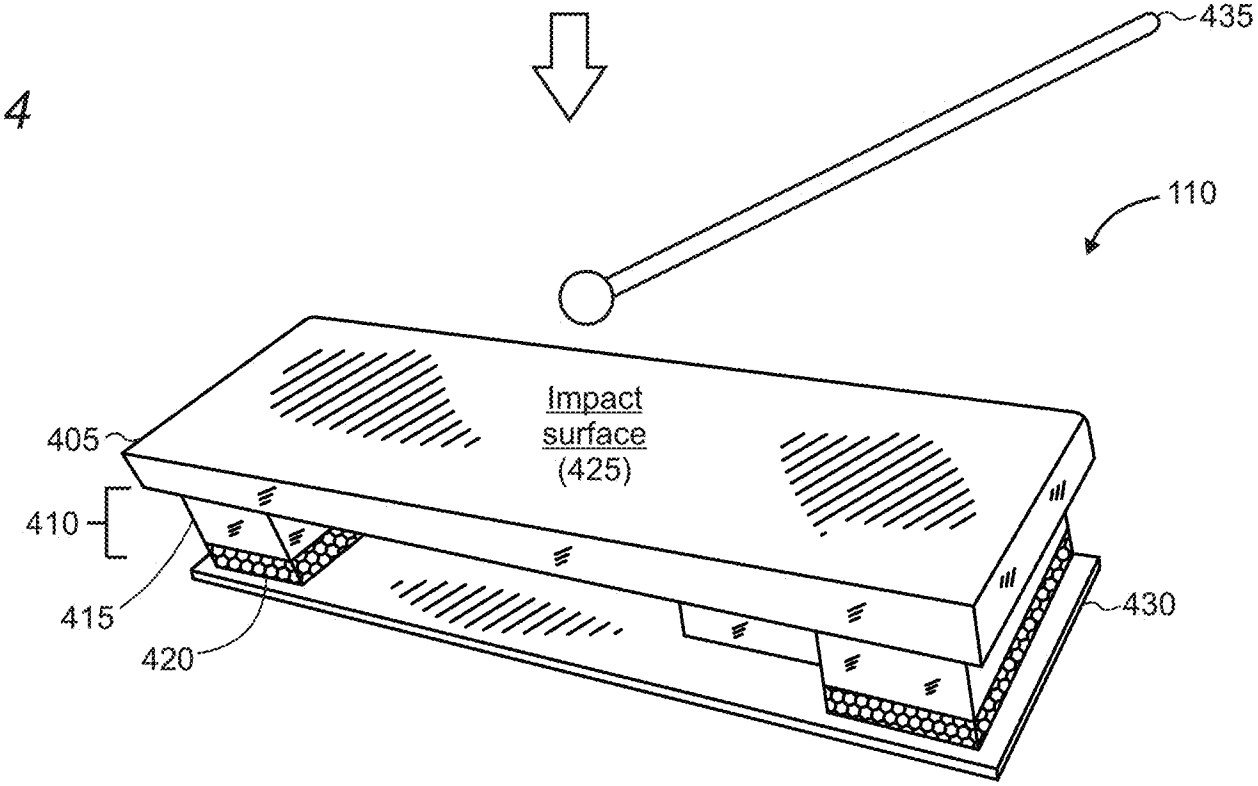
FIG. 4 shows an illustrative representation of a xylosynth key.

FIG. 4 shows an illustrative representation in which a mallet 435 is used to strike an impact surface 425 on the key's percussion layer 405. The percussion layer may be comprised of wood or other material depending on the percussion instrument, such as plastic, a drumskin made of one or both of animal skin or synthetic material, metal, etc. Underneath the percussion layer is foam layers 410, which includes a closed-cell foam layer 415, positioned directly underneath an underside of the percussion layer 405, and an open-cell foam layer 420 positioned underneath the closed-cell foam layer 415.

Each of the closed-cell and open-cell foam layers 415, 420 may have an adhesive on their top and bottom sides to enable a secure attachment of the foam layers to each other and other components on the mount. For example, the top surface of the closed-cell foam layer attaches to the underside of the percussion layer 405, and the bottom surface of the open-cell foam layer 420 attaches to a top surface of a mounting bracket 430. The mounting bracket 430 may be comprised of metal, plastic, or other material to secure the key to the xylosynth's or other percussion instrument's frame. Although the mounting bracket is shown herein, in other implementations, the bottom of the open-cell foam layer 420 may attach directly to a single frame for the percussion instrument (e.g., xylosynth), in which case the mounting bracket 430 is not used. Connecting the foam layer 410 directly to the mounting bracket and frame depends on the specific implementation.

Figure 5:
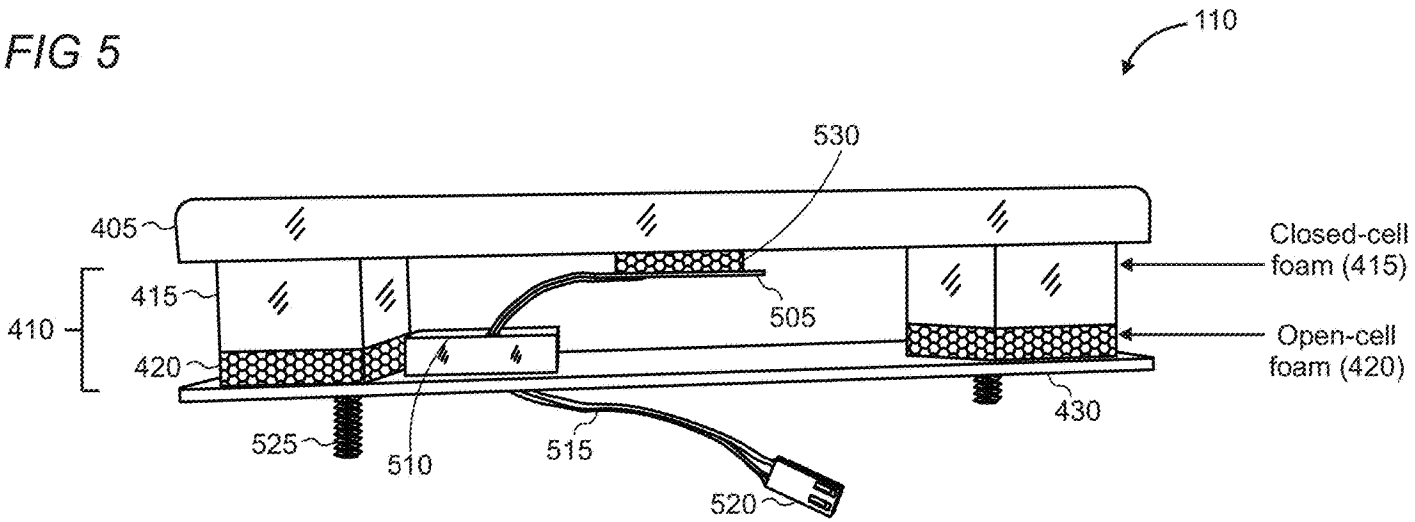
FIGS. 5 and 6 show illustrative representations of the key's components and configuration.
Figure 6:
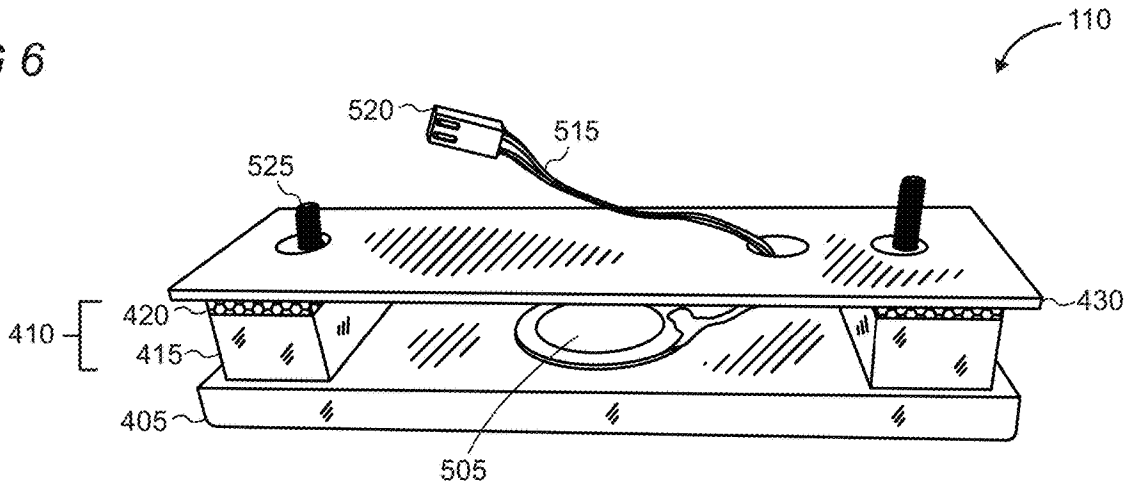

FIGS. 5 and 6 show illustrative representations that show the various components and configurations for the key 110. Attached to an underside of the percussion layer 405 is the vibration sensor 505 and a semi-closed cell foam layer 530. The semi-closed cell foam is positioned between the sensor and the percussion layer 405. The semi-closed cell foam layer 530 is comprised of a relatively stiffer polythene material that allows the vibrations to pass through to the sensor 505 while still reducing the shock waves when there is an impact directly above it on the impact surface 425. The closed-cell foam 530 is predominantly closed-cell but typically may not have the flexibility of the EPDM material. It is also easier to peel off the protective paper before sticking to the underside of the percussion layer 405 since there is some thickness, such as 2 mm thick foam.

As discussed above, the sensor detects the vibrations generated from an impact from a mallet, drumstick, hands, or other force. A wire 515 transfers the generated vibration signal by the sensor to a plug 520 that may connect to a printed circuit board (PCB) or plug for transmission to the signal processor 215 (FIGS. 2 and 3). The wire may be routed through holes in the cable guide foam layer 510 and the mounting bracket 430. Further discussion about the xylosynth's and similar percussion instrument configurations and method of operation can be viewed at U.S. Pat. No. 9,837,062, filed Jan. 5, 2017, issued Dec. 5, 2017, entitled "Percussion Instrument and Signal Processor," the entire contents of which is hereby incorporated herein by reference. Screws 525 or other bolts may extend from a bottom surface of the mounting bracket 430 for securing the key to a frame on the percussion instrument. Each key may be mounted to a frame to create, for example, various tones, as shown by the xylosynth in FIG. 1.

Figure 7:
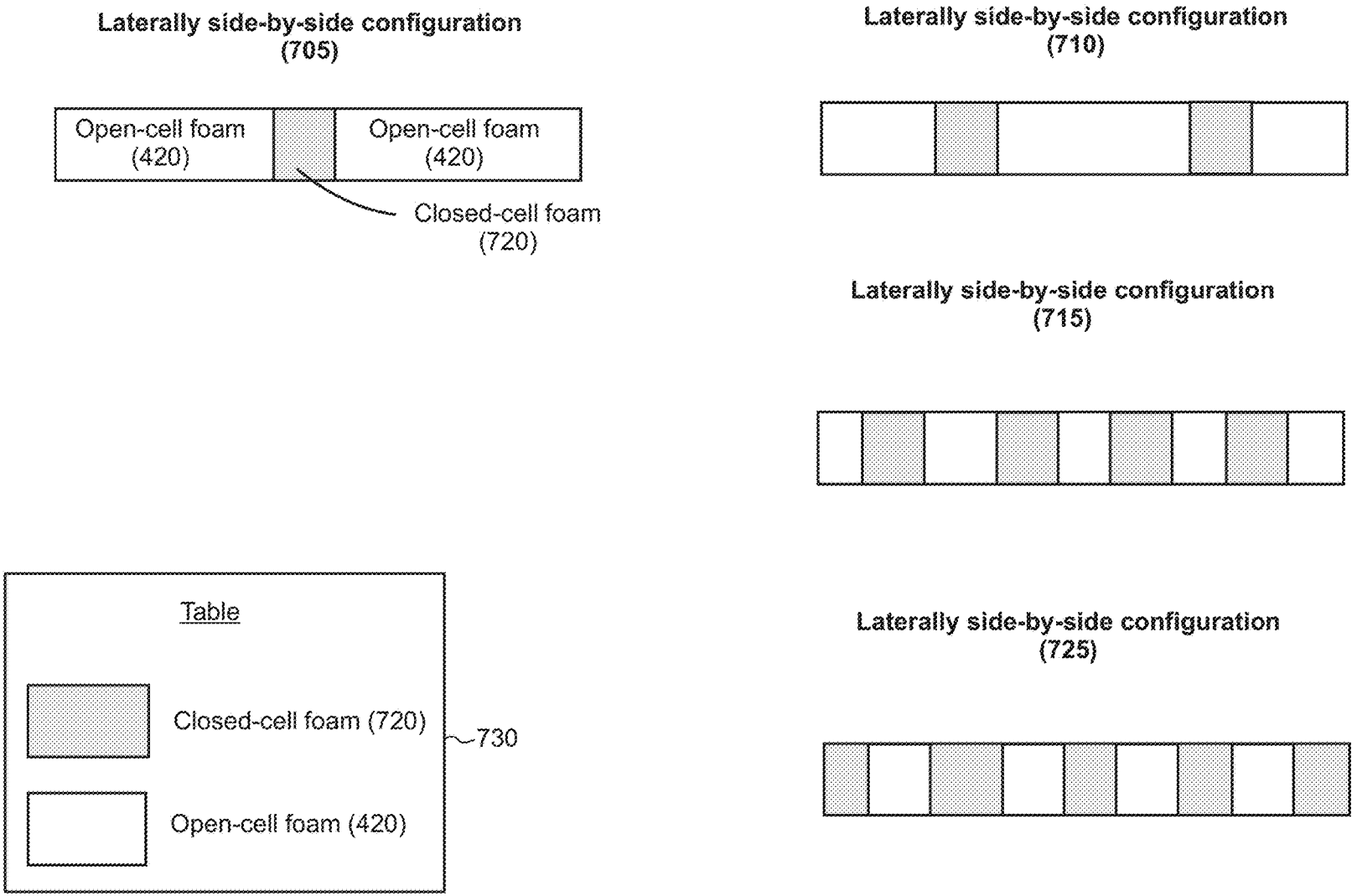
FIG. 7 shows illustrative representations of laterally side-by-side open-cell and closed-cell foam arrangements.

FIG. 7 shows illustrative schematic representations in which the open-cell foams 420 and closed-cell foams 720 can have various arrangements depending on a specific implementation and/or scenario. For example, with reference to table 730, the foams can be arranged in laterally side-by-side configurations according to reference numerals 705, 710, 715, and 725. In each example, the closed-cell foam 720 functions as a spring for the dual-foam hybrid layer, and the open-cell foam 420 functions as a damper to the vibrations.

The specific properties associated with the closed-cell and open-cell foams 420, 720 create this simultaneously cohesive environment and functionality. For example, in typical implementations, each foam layer may be comprised of an EPDM (ethylene propylene diene monomer rubber) material which is configured with properties that effectuate the benefits described above, namely the dampening functionality for the open-cell foam layer and the spring functionality for the closed-cell foam layer. Although the closed-cell foam is used for the spring-like functionality discussed herein, other components that have spring-like functionality could also be used in place of the closed-cell foam, such conventional metal or plastic springs including a constant coil or flat springs, among other spring-like structures.

Based on the EPDM properties, the air inside the closed-cell foam 720 cannot enter or escape the cellular structure, but the cells can be flattened to an extent, thereby providing the spring-like functionality. For the open-cell foam 420, air can enter and escape the cellular structure but is restricted as it passes through the cells that can be flattened, thereby providing the dampening functionality to the transferred vibrations.

Figure 8:
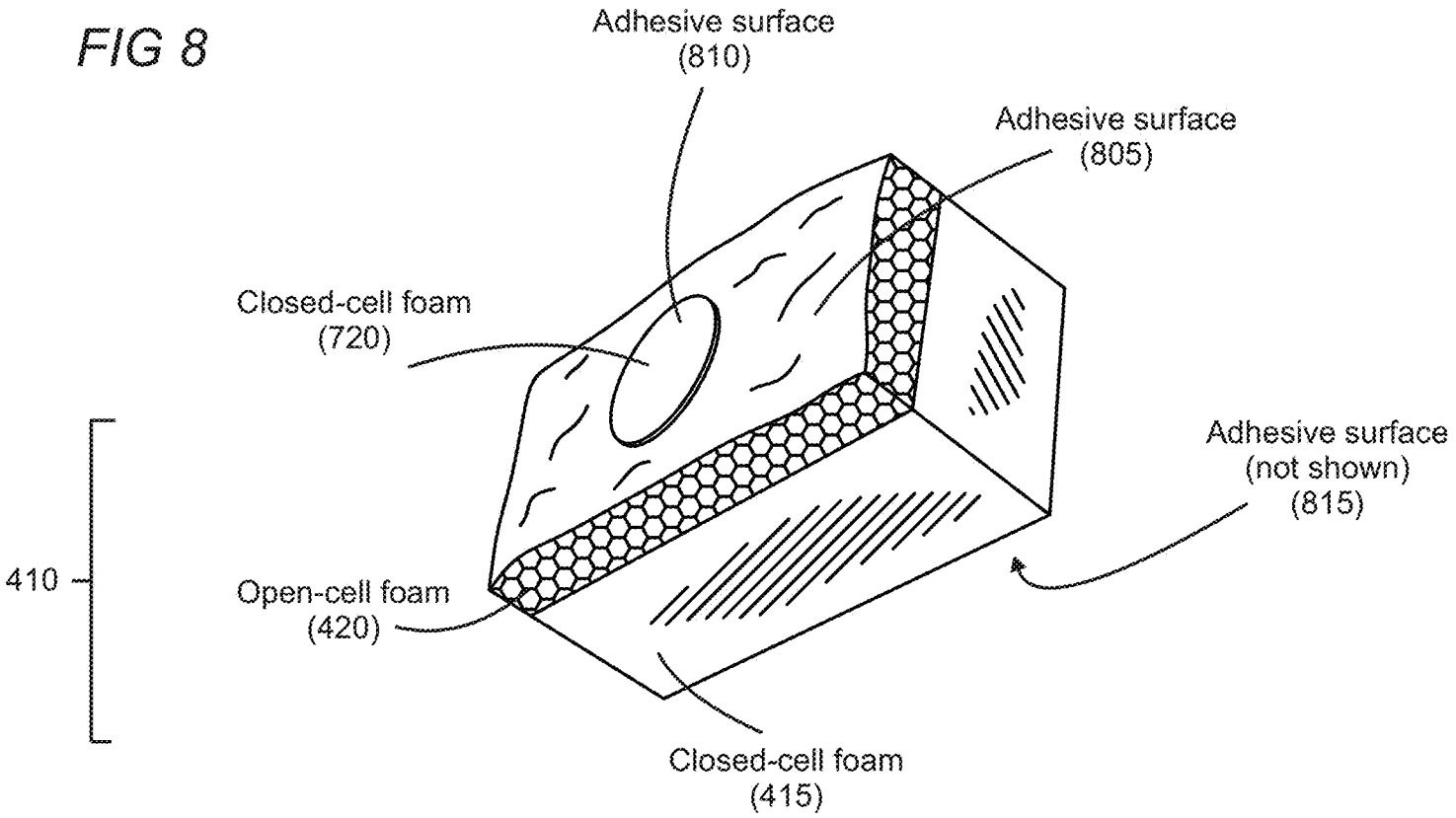
FIG. 8 shows an illustrative representation of the foam layers.

FIG. 8 shows an illustrative representation of the laterally side-by-side arrangement 705, shown in FIG. 7. The open-cell foam 420 is positioned on top of the closed-cell foam 415. Side-by-side to the open-cell foam 420 is the closed-cell foam 720 to provide the dual-layer hybrid functionality presented by the two layers. Furthermore, the open-cell foam 420 and the closed-cell foam 720 include adhesive surfaces 805, 810 to attach the surface to mount bracketing 430 (FIGS. 4-6). An adhesive may likewise be attached to one or both of the open-cell foam 420 or the closed-cell foam 415 to attach to each other. The bottom of the closed-cell foam 415 also includes an adhesive surface 815 (not shown) to attach to the percussion layer 405 (FIGS. 4-6).

Figure 9:
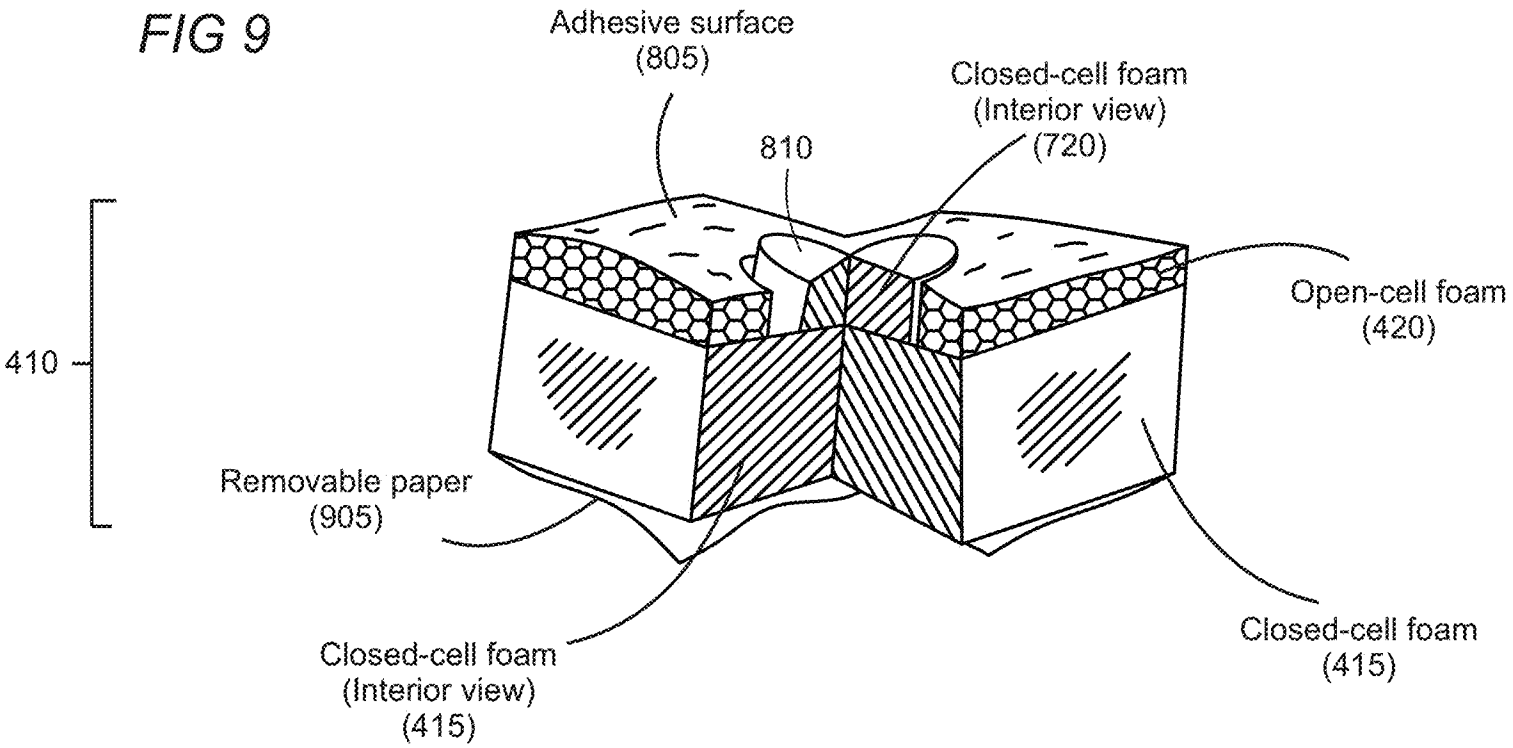
FIG. 9 shows an interior representation of the foam layers and their side-by-side configuration.

FIG. 9 shows an illustrative representation in which the interior configuration of the foam layer 410 shows the laterally side-by-side arrangement 705. The closed-cell foam 720 is positioned laterally adjacent to the open-cell foam layer 420. In some implementations, the open-cell foam layer can include one or more holes inside which the closed-cell foam is inserted. In this example, the open-cell foam layer surrounds the closed-cell foam layer 720. Such a configuration enables any noise or interference from vibrations to transfer to the dampening properties of the open-cell foam 420. Although specific sizes, shapes, and dimensions are shown in FIGS. 8 and 9, other designs are also possible. For example, the closed-cell foam layer 720 and the open-cell foam layer 420 may be square, rectangular, polygonal, oval, etc. Also, in some implementations, the closed-cell foam layer 720 may not be completely surrounded, as shown in FIGS. 8 and 9.

In the examples shown, the open-cell foam layer 420 and closed-cell foam layer 720 may be in contact with each other or may have a distance from each other. For example, the interior surface of the open-cell foam may completely or partially touch the exterior walls of the closed-cell foam.

The closed-cell foam layer 720 extends to the other closed-cell foam layer 415. These top and bottom layers may be two distinct components attached together, such as via adhesive, or in some implementations, the closed-cell foam 720 may be an upward extension of the closed-cell foam layer 415 through a hole in the open-cell foam 420. Removable paper 905 may be placed on a bottom layer of the closed-cell foam to protect the adhesive before use. Removable paper may likewise be placed on the top surfaces of the open-cell foam 420 and the closed-cell foam 720. The top surfaces of the closed-cell foam 720 and open-cell foam 420 may be substantially planar and even to each other, or the closed-cell foam layer may be slightly higher than the open-cell foam. In other implementations, the closed-cell foam 720 may be slightly shorter than the open-cell foam's height.

Figure 10:
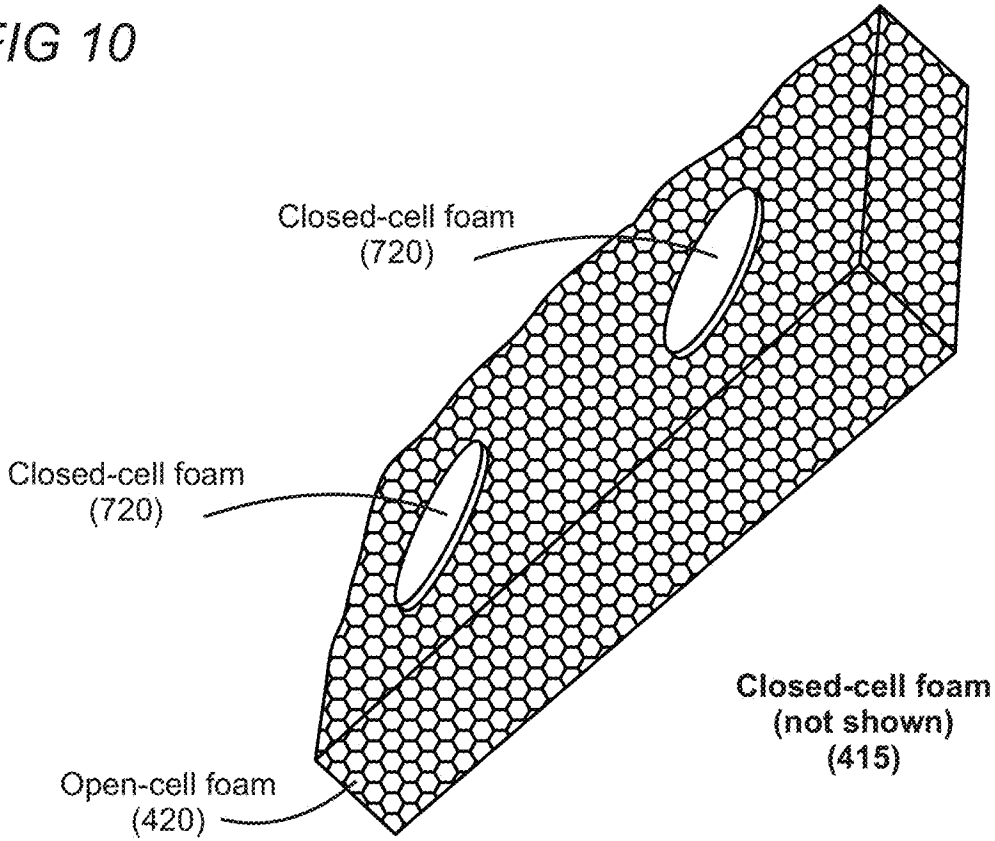
FIG. 10 shows an illustrative representation of a side-by-side arrangement of the foam layers.

FIG. 10 shows an illustrative representation in which the laterally side-by-side arrangement 710 (FIG. 7) is implemented. The open-cell foam layer 420 may include two holes (or more in other implementations) that accommodate closed-cell foam layers 720. The open-cell foam also surrounds the closed-cell foam layers in this example. Although not shown, the closed-cell foam layer 415 would be positioned underneath the side-by-side foam layer.

Figure 11:
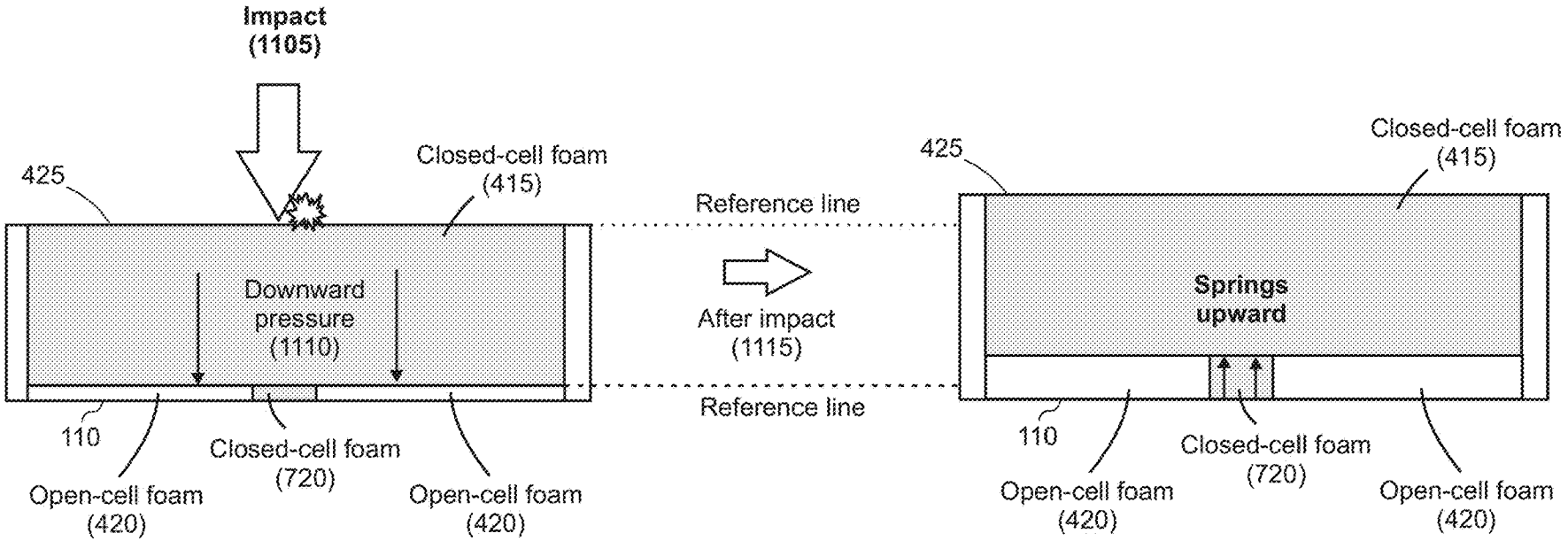
FIG. 11 shows an illustrative environment of the foam layers' functionality after impact.

FIG. 11 shows an illustrative representation in which impact 1105 from an external force, such as a mallet, drumstick, user's hand, etc., strikes the key's impact surface 425, which causes downward pressure 1110. The downward pressure is exerted against the side-by-side configuration of the open-cell foam 420 and the closed-cell foam 720. Such downward pressure causes some compression of the dual-foam layer, as representatively shown by the reference lines relative to the normal/standard position of the key on the right.

After impact, as representatively shown by numeral 1115, the closed-cell foam 720 springs upward back into its baseline position, as shown by the reference lines relative to the impacted key on the left in FIG. 11. This springing momentum and force cause the open-cell foam layer 420, the closed-cell foam layer 415, and the entire or at least portions of the key to likewise spring upward back into position. Thus, the key can be back into position quicker for further striking, such as while playing the instrument at various paces while still reducing noise transfer to surrounding keys.

The cellular properties of the closed-cell foam 720 and open-cell foam 420 enable the key 110 to quickly spring back into position while eliminating—or at least reducing—interference generated from vibrations brought on by the impact 1105. For example, one or both of the foam's properties and the side-by-side configuration reduce acoustic impact sounds when the instrument is struck, isolate vibrations from nearby percussion surfaces, and reduce or remove sound generation when air is released from the damper. Any interference, such as vibrations or air that may move toward the key, may likewise be reduced by the open-cell foam 420 capturing and subduing such interferences. Therefore, the side-by-side configuration reduces noise transferred outward by the key and inward from surrounding keys (see FIG. 1 for an exemplary key arrangement).

Figure 12:
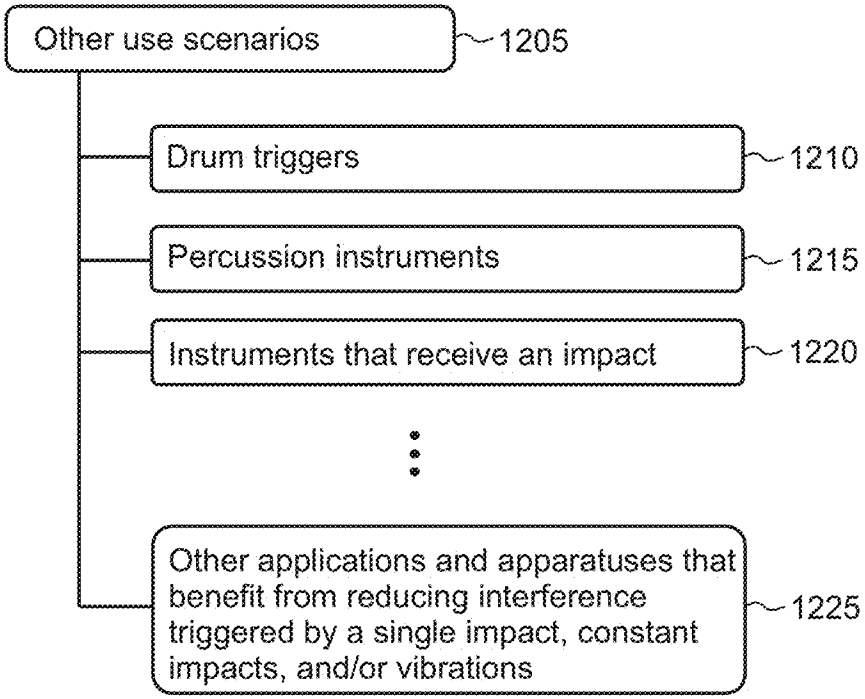
FIG. 12 shows a schema of alternative use scenarios for the side-by-side foam layer arrangement discussed herein.

FIG. 12 shows an illustrative schema of other use scenarios 1205 of the foam arrangement for percussion instruments disclosed herein. Exemplary and non-exhaustive alternative scenarios include drum triggers 1210, other percussion instruments 1210 (e.g., that use different striking mechanisms, sensors, or arrangements with the foam), instruments that receive an impact 1220, other applications and apparatuses that can benefit from reducing interference triggered by a single impact, multiple impacts, and/or vibrations 1225. For example, in some scenarios, impacts may cause vibrations to a structure and those vibrations of the structure may react with further impacts of the structure when combined.

Figure 13A:
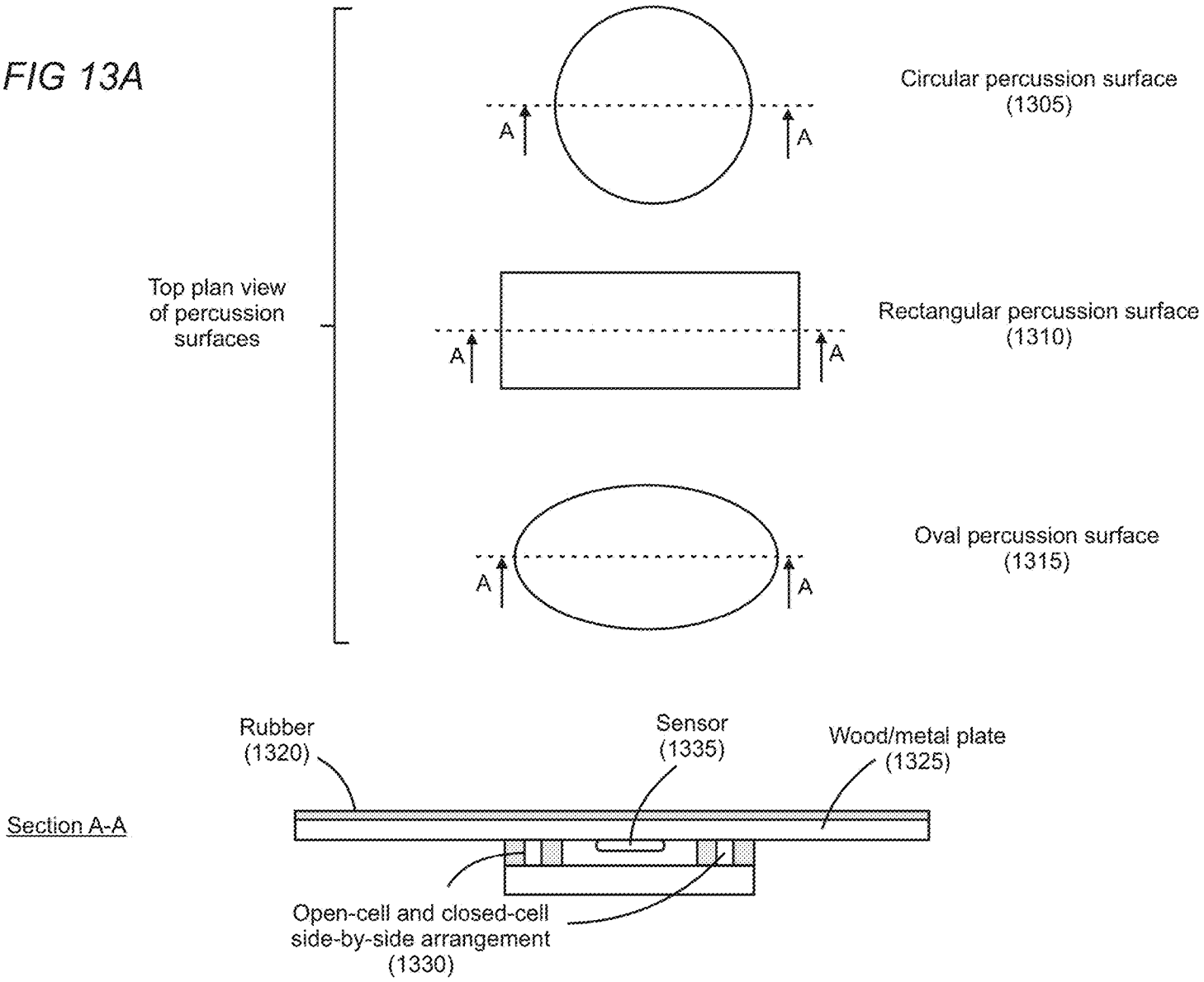
FIG. 13A shows an illustrative representation of the side-by-side foam arrangement applied to an electronic percussion instrument.

FIG. 13A shows an illustrative representation in which electronic drum surfaces can utilize and implement the spring-damper system disclosed herein. The electronic drum surfaces can have circular, rectangular, or ovular percussion surfaces, as representatively shown from numerals 1305, 1310, and 1315. Section A-A depicts how the open-cell and closed-cell side-by-side foam arrangement 1330 (FIG. 7) can be implemented on drum stands utilizing tube or round bar support. The electronic percussion instrument includes a rubber 1320 on top of a wood or metal plate 1325. A sensor 1335 may be positioned underneath the wood or metal plate to detect some striking impact from a user. Additional components not shown would be present, such as a connector, supporting member, and mounting bracket. The open-cell and closed-cell foam arrangement 1330 may function similarly as described above, such as by providing a spring and damper functionality.

Figure 13B:
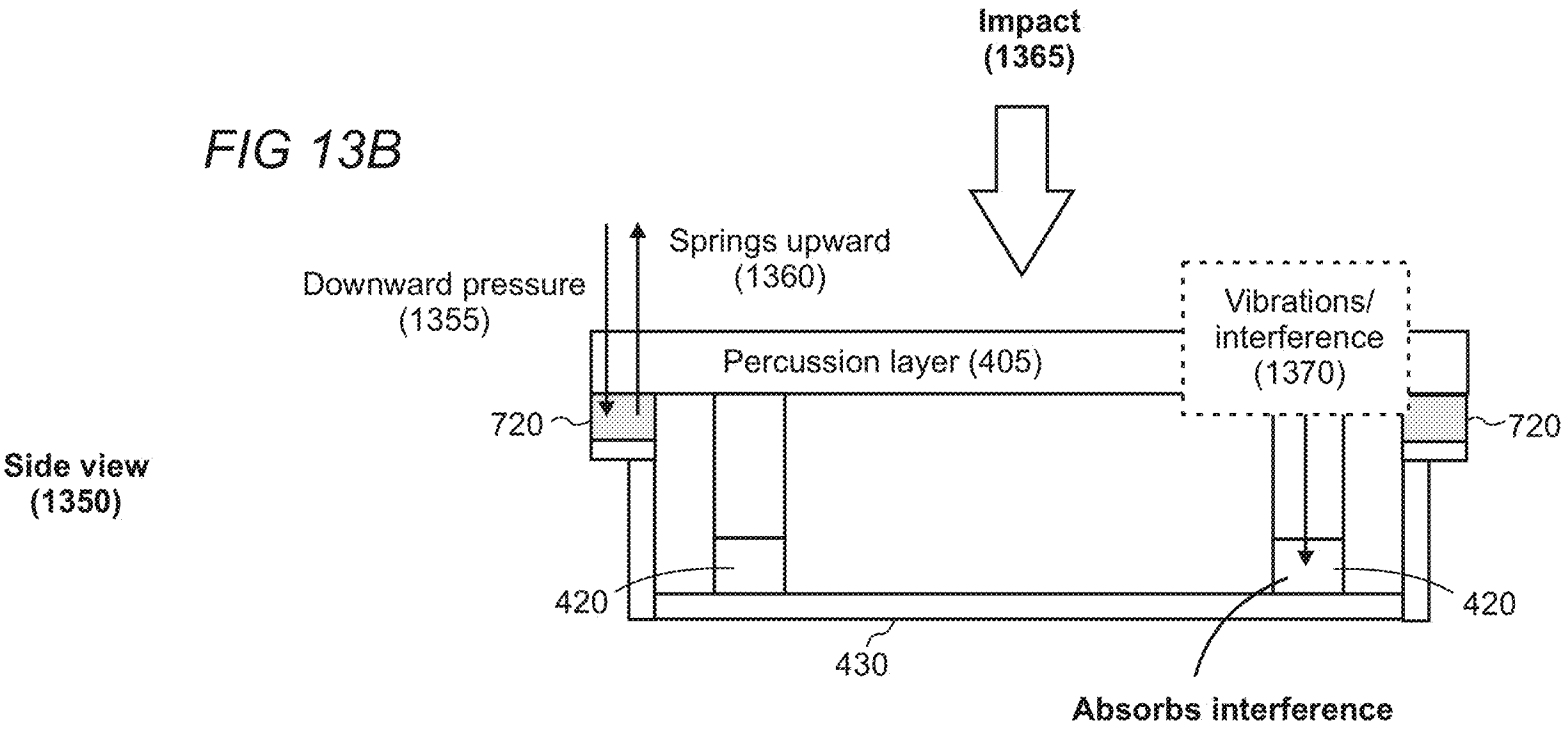
FIG. 13B shows an illustrative representation in which the foams are arranged geometrically side-by-side with a distance between each other such that the foams operate in parallel to each other.

FIG. 13B shows an illustrative side view 1350 diagram of the percussion instrument with a different arrangement in which the open-cell foam 420 and closed-cell foam 720 operate parallel to and distinct from each other. For example, the open-cell foam 420 is mounted to the mounting bracket 430 (or frame in other implementations), and the closed-cell foam is attached to the underside of the percussion layer 405. While the two foams have a distance/space between them, they still perform their intended functions discretely. While FIG. 13B focuses on a single foam layer's operations, the same features may be present on the opposite side; a single side was focused on for clarity in exposition.

Responsive to impact 1365, the closed-cell foam layers 720 receive a downward pressure 1355 that may cause them to retract. The closed-cell foam's spring-like properties still cause the percussion layer 105 to spring upwards 1360 back into position, similarly as discussed above with the other arrangements (FIG. 7). Furthermore, vibrations/interference 1370 from the impact 1365 are transferred to the open-cell foam layers 420, which then executes its dampening functionality to reduce or remove the vibrational interferences from the strike, such as by absorbing the interference in its cell structure. Furthermore, the open-cell foam structures may still serve to absorb interferences from surrounding keys or percussion surfaces. Thus, FIG. 13B shows an alternate configuration in which the open- and closed-cell foam layers are arranged remote from each other but still independently operate to effectuate their functional properties. In this example, the foams are arranged side-by-side but at different planes to each other. Although not shown, in some implementations, the foam layers may partially or fully vertically overlap with each other, depending on the specific setup of the percussion instrument.

Figure 14:
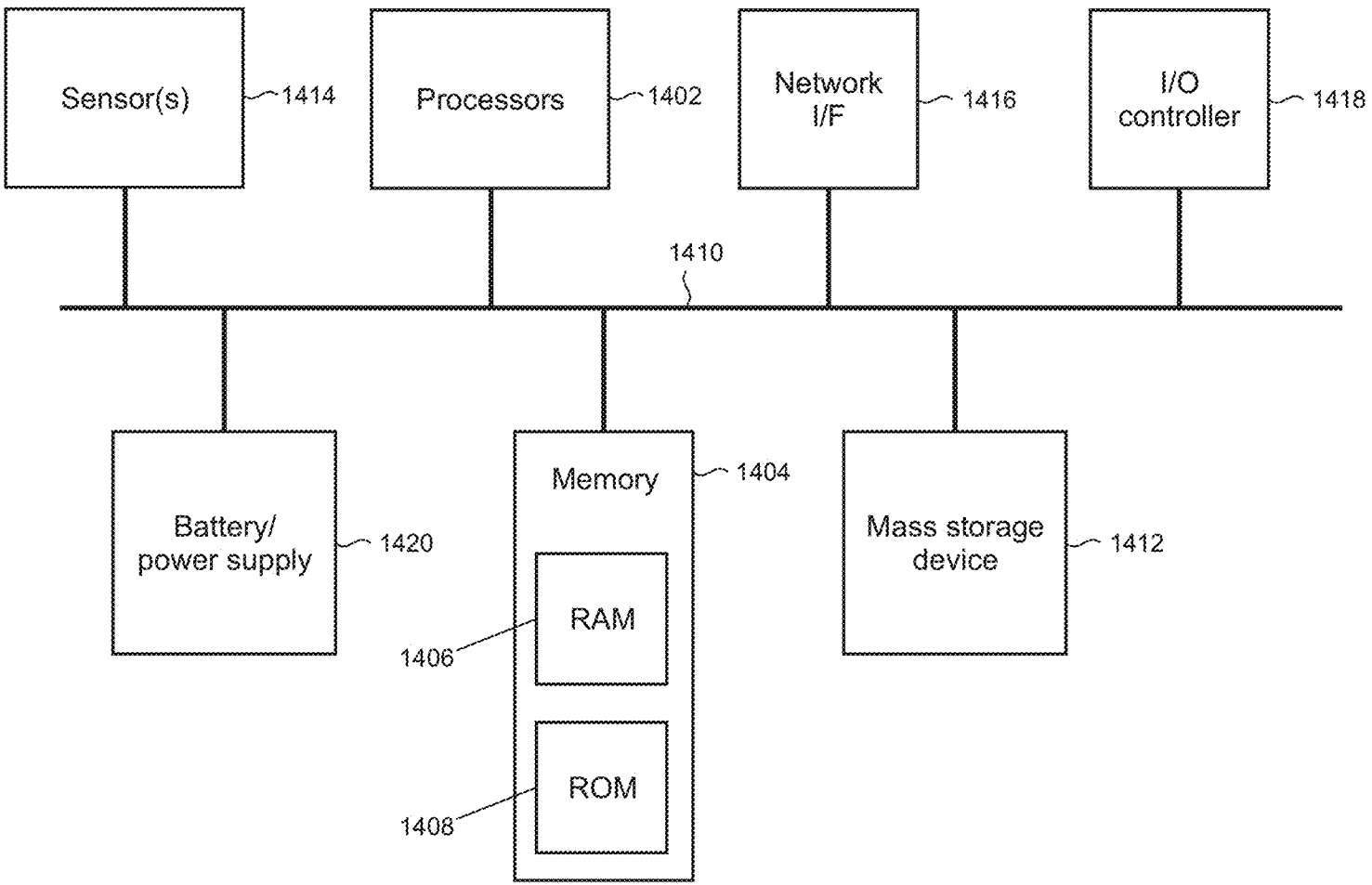
FIG. 14 is a simplified block diagram of an illustrative architecture of a computing device implemented with the percussion instrument that may be used at least in part to implement the present isolation mount for a percussion instrument.

FIG. 14 shows an illustrative diagram of a computer system that may be utilized by the percussion instrument, such as a xylosynth, described herein. The architecture 1400 illustrated in FIG. 14 includes one or more processors 1402 (e.g., central processing unit, dedicated Artificial Intelligence chip, graphics processing unit, etc.), a system memory 1404, including RAM (random access memory) 1406 and ROM (read-only memory) 1408, and a system bus 1410 that operatively and functionally couples the components in the architecture 1400. A basic input/output system containing the basic routines that help to transfer information between elements within the architecture 1400, such as during startup, is typically stored in the ROM 1408. The architecture 1400 further includes a mass storage device 1412 for storing software code or other computer-executed code that is utilized to implement applications, the file system, and the operating system. The mass storage device 1412 is connected to the processor 1402 through a mass storage controller (not shown) connected to bus 1410. The mass storage device 1412 and its associated computer-readable storage media provide non-volatile storage for the architecture 1400. Although the description of computer-readable storage media contained herein refers to a mass storage device, such as a hard disk or CD-ROM drive, it may be appreciated by those skilled in the art that computer-readable storage media can be any available storage media that can be accessed by the architecture 1400.

By way of example, and not limitation, computer-readable storage media may include volatile and non-volatile, removable and non-removable media implemented in any method or technology for storage of information such as computer-readable instructions, data structures, program modules, or other data. For example, computer-readable media includes, but is not limited to, RAM, ROM, EPROM (erasable programmable read-only memory), EEPROM (electrically erasable programmable read-only memory), Flash memory or other solid-state memory technology, CD-ROM, DVD, HD-DVD (High Definition DVD), Blu-ray, or other optical storage, a magnetic cassette, magnetic tape, magnetic disk storage or other magnetic storage device, or any other medium which can be used to store the desired information and which can be accessed by the architecture 1400.

According to various embodiments, the architecture 1400 may operate in a networked environment using logical connections to remote computers through a network. The architecture 1400 may connect to the network through a network interface unit 1416 connected to the bus 1410. It may be appreciated that the network interface unit 1416 also may be utilized to connect to other types of networks and remote computer systems. The architecture 1400 also may include an input/output controller 1418 for receiving and processing input from a number of other devices, including a keyboard, mouse, touchpad, touchscreen, control devices such as buttons and switches, or electronic stylus (not shown in FIG. 14). Similarly, the input/output controller 1418 may provide output to a display screen, user interface, a printer, or other output device types (also not shown in FIG. 14).

It may be appreciated that the software components described herein may, when loaded into the processor 1402 and executed, transform the processor 1402 and the overall architecture 1400 from a general-purpose computing system into a special-purpose computing system customized to facilitate the functionality presented herein. The processor 1402 may be constructed from any number of transistors or other discrete circuit elements, which may individually or collectively assume any number of states. More specifically, the processor 1402 may operate as a finite-state machine in response to executable instructions contained within the software modules disclosed herein. These computer-executable instructions may transform the processor 1402 by specifying how the processor 1402 transitions between states, thereby transforming the transistors or other discrete hardware elements constituting the processor 1402.

Encoding the software modules presented herein also may transform the physical structure of the computer-readable storage media presented herein. The specific transformation of physical structure may depend on various factors in different implementations of this description. Examples of such factors may include but are not limited to, the technology used to implement the computer-readable storage media, whether the computer-readable storage media is characterized as primary or secondary storage, and the like. For example, if the computer-readable storage media is implemented as semiconductor-based memory, the software disclosed herein may be encoded on the computer-readable storage media by transforming the physical state of the semiconductor memory. For example, the software may transform the state of transistors, capacitors, or other discrete circuit elements constituting the semiconductor memory. The software also may transform the physical state of such components in order to store data thereupon.

As another example, the computer-readable storage media disclosed herein may be implemented using magnetic or optical technology. In such implementations, the software presented herein may transform the physical state of magnetic or optical media when the software is encoded therein. These transformations may include altering the magnetic characteristics of particular locations within given magnetic media. These transformations also may include altering the physical features or characteristics of particular locations within given optical media to change the optical characteristics of those locations. Other transformations of physical media are possible without departing from the scope and spirit of the present description, with the foregoing examples provided only to facilitate this discussion.

The architecture 1400 may further include one or more sensors 1414 or a battery or power supply 1420. The sensors may be coupled to the architecture to pick up data about an environment or a component, including temperature, pressure, etc. Exemplary sensors can include a thermometer, accelerometer, smoke or gas sensor, pressure sensor (barometric or physical), light sensor, ultrasonic sensor, gyroscope, among others. The power supply may be adapted with an AC power cord or a battery, such as a rechargeable battery for portability.

In light of the above, it may be appreciated that many types of physical transformations take place in architecture 1400 in order to store and execute the software components presented herein. It also may be appreciated that the architecture 1400 may include other types of computing devices, including wearable devices, handheld computers, embedded computer systems, smartphones, PDAs, and other types of computing devices known to those skilled in the art. It is also contemplated that architecture 1400 may not include all of the components shown in FIG. 14, may include other components that are not explicitly shown in FIG. 14, or may utilize an architecture completely different from that shown in FIG. 14.

The discussion herein discloses various embodiments for an isolation mount for percussion instruments. In one exemplary embodiment, disclosed is a percussion instrument configured to reduce vibrational interference, comprising: a percussion layer having a percussion surface adapted to receive an external impact; a spring mechanism directly or indirectly in communication with the percussion surface; and a damper directly or indirectly in communication with the percussion surface, wherein the spring mechanism and damper are arranged in a laterally side-by-side arrangement to each other.

As a further example, the spring mechanism is comprised of a closed-cell foam. In another example, the damper is comprised of an open-cell foam. As another example, the open-cell foam at least partially surrounds the closed-cell foam. As another example, the open-cell foam completely surrounds the closed-cell foam. In another example, responsive to the closed-cell foam and open-cell foam compressing from the external impact, the closed-cell foam springs the percussion layer back into position, and the open-cell foam absorbs vibrational interference created from the external impact. As a further example, a top side and a bottom side of the open-cell and closed-cell foam layers are substantially planar relative to each other. As a further example, a distinct closed-cell foam is attached to an underside of the percussion layer, and a top surface of the open-cell and closed-cell foam are attached to a bottom surface of the distinct closed-cell foam. In another example, an adhesive layer is applied to a top surface and the bottom surface of the distinct closed-cell foam, and an adhesive layer is applied to the top surface and a bottom surface of the open-cell and closed-cell foam. In another example, the spring mechanism and damper have a distance between each other. As another example, the spring mechanism and damper laterally touch each other.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A percussion instrument configured to reduce vibrational interference, comprising:

a percussion layer having a percussion surface adapted to receive an external impact;

a spring mechanism directly or indirectly in communication with the percussion surface; and a damper directly or indirectly in communication with the percussion surface, wherein the spring mechanism and damper are arranged in a laterally side-by-side arrangement to each other.

2. The percussion instrument of claim 1, wherein the spring mechanism is comprised of a closed-cell foam.

3. The percussion instrument of claim 2, wherein the damper is comprised of an open-cell foam.

4. The percussion instrument of claim 3, wherein the open-cell foam at least partially surrounds the closed-cell foam.

5. The percussion instrument of claim 4, wherein the open-cell foam completely surrounds the closed-cell foam.

6. The percussion instrument of claim 5, wherein, responsive to the closed-cell foam and open-cell foam compressing from the external impact, the closed-cell foam springs the percussion layer back into position, and the open-cell foam absorbs vibrational interference created from the external impact.

7. The percussion instrument of claim 5, wherein a top side and a bottom side of the open-cell and closed-cell foam layers are substantially planar relative to each other.

8. The percussion instrument of claim 5, wherein a distinct closed-cell foam is attached to an underside of the percussion layer, and a top surface of the open-cell and closed-cell foam are attached to a bottom surface of the distinct closed-cell foam.

9. The percussion instrument of claim 8, wherein an adhesive layer is applied to a top surface and the bottom surface of the distinct closed-cell foam, and an adhesive layer is applied to the top surface and a bottom surface of the open-cell and closed-cell foam.

10. The percussion instrument of claim 1, wherein the spring mechanism and damper have a distance between each other.

11. The percussion instrument of claim 1, wherein the spring mechanism and damper laterally touch each other.

* * * * *